US006164266A

United States Patent [19]

Just et al.

[11] Patent Number: 6,164,266

[45] Date of Patent: Dec. 26, 2000

[54] MAGNET COIL USED IN A FUEL INJECTION PUMP

[75] Inventors: Bernhard Just, Kernen; Martin Metzger, Reutlingen; Andreas Eckert; Andreas Dutt, both of Stuttgart; Karl Hoss, Villingen-Schwenningen, all of Germany

[73] Assignees: Robert Bosch GmbH, Stuttgart; Helmut Hechinger GmbH & Co., Villingen-Schwenningen, both of Germany

[21] Appl. No.: 09/202,182

[22] PCT Filed: Apr. 3, 1998

[86] PCT No.: PCT/DE98/00942

§ 371 Date: Sep. 7, 1999

§ 102(e) Date: Sep. 7, 1999

[87] PCT Pub. No.: WO98/45860

PCT Pub. Date: Oct. 15, 1998

[30] Foreign Application Priority Data

Apr. 10, 1997 [DE] Germany ..... 197 14 812

[51] Int. Cl.[7] ..... F02M 33/04

[52] U.S. Cl. ..... 123/506; 29/608

[58] Field of Search ..... 29/606, 608; 251/129.21; 123/495, 457–8, 506

[56] References Cited

U.S. PATENT DOCUMENTS

| | | | |
|---|---|---|---|
| 4,944,486 | 7/1990 | Babitzka | 251/129.21 |
| 4,996,764 | 3/1991 | Babitzka | 29/608 |
| 5,331,730 | 7/1994 | Brinn, Jr. | 29/606 |
| 5,581,871 | 12/1996 | Yasuno | 29/606 |
| 5,785,394 | 7/1998 | Volpe et al. | 303/119.2 |

*Primary Examiner*—Thomas N. Moulis
*Attorney, Agent, or Firm*—Ronald E. Greigg; Edwin E. Greigg

[57] ABSTRACT

A magnet coil which is disposed in a cup-shaped housing that has stub for carrying magnetic flux to a magnet armature; the positioning of the magnet coil inside this cup-shaped housing is defined by an insulation spray coating, and the magnet coil has contact terminals which protrude to the outside, having been spray-coated with insulation, through the bottom of the cup-shaped housing. The bottom of the cup-shaped housing also has a third opening, which is likewise filled by material and which offers an opportunity, during the spray-coating, of introducing a rodlike part to support the magnet coil.

11 Claims, 2 Drawing Sheets

MAGNET COIL USED IN A FUEL INJECTION PUMP

PRIOR ART

The invention is based on a magnet coil used in a fuel distribution pump. One such known coil is used in a distributor fuel injection pump in accordance with German Patent Disclosure DE-A1 43 39 948. The magnet coil provided there is part of a magnet valve of a distributor fuel injection pump and is exposed to the fuel during operation. The known magnet coil is mounted on a winding body of insulating material and is closed afterward by an additional plastic overlay. The plastic winding body has extensions of insulating material, inside which the contact terminals of the magnet coils are guided. The regions of the contact terminals thus surrounded by insulating material are extended through the openings in the bottom of the housing and are sealed off, resting on the outside, by seals on a closure plate which otherwise seals off the fuel-carrying chamber of the fuel injection pump from the outside.

In the known magnet coil, this coil is thus built; that is, first the magnet coil carrier, then the winding, and then finally a covering with which the magnet coil is to be closed in fuel-tight fashion are made. The entire coil is disposed inside an annular chamber of the housing that is formed by the stub together with the circumferential wall of the cup-shaped housing. This chamber only partly fills the magnet coil, and transverse connections are formed both in the stub and in the circumferential wall of the cup-shaped housing; their task is to rinse the magnet coil intensively with fuel and thus bring about a temperature equalization. This has the disadvantage that the effort and expense of production for such a magnet coil is relatively high, especially because it is made up of multiple parts.

ADVANTAGES OF THE INVENTION

The magnet coil of the invention has the advantage over the prior art that in a simple way, accurate positioning of the magnet coil inside the cup-shaped housing is realized, and in a simple way a highly tight closure of the current-carrying parts of the magnet coil off from the outside is attained. The magnet coil joins the walls of the surrounding cup-shaped housing so as to make an intensive contact. The magnet coil is securely fixed in this housing as well, and an exact association with a magnet armature of the magnet coil is attainable. The openings, which are necessary for extending the contact terminals to the outside from the chamber exposed to the fuel, are intensively filled with insulating material and sealed off by spray-coating the magnet coil. Accordingly, to attain a secure, accurate positioning of the magnet coil inside the insulating material surrounding it, a third opening is made in the cup-shaped housing, through which a supporting part can be introduced. This part together with the contact terminals of the magnet coil serves the purpose of positional fixation. In this way, it is possible during the spray-coating of the magnet coil with insulating material to adhere exactly to the position of the magnet coil. Thus, the electrical values and the magnetic forces that act on an armature can be adhered to exactly as well. As set forth, the disposition of the third opening, through which a rodlike part can be introduced, and the location of the contact terminals are selected such that a stable three-point support of the coil during the spray-coating process is made possible.

Further, a measurement location outside the cup-shaped part is created, which assures that the internal region of the cup-shaped housing is completely filled with the spray-coating of the magnet coil, and that a removal of the rodlike part is then still possible even during the spray-coating process, so that a complete closure of the third opening and of the coil at this point with insulating material takes place. This stub, if the magnet coil is used in an application according to the prior art, need not have any communication between fuel-carrying chambers and non-fuel-carrying chambers or the environment, so that no sealing, as is required for the contact terminals that must have such a communication, is needed at this stub.

To produce a magnet coil in the embodiment above, according to the invention a method is disclosed. Because a pressure measurement is made in the region of the third opening continuously during the spray-coating process, and this measurement indicates the fact as soon as insulating material emerges from the third opening and reaches the region of the pressure sensor, it is assured that at this moment the spray-coating of the magnet coil is concluded in a way that contacts the housing on the inside. Thus the location of the magnet coil inside the housing can no longer change, making it unnecessary to provide positional fixation by the rodlike part from this moment on; that is, the rodlike part can be removed from the cup-shaped housing from its spray coating even before the spray-coating process has been concluded. Once this rodlike part which retracts is removed, the remainder of the interior on the far side of the bottom of the cup-shaped housing is finally filled with insulating material.

An apparatus for performing this method accordingly has a receptacle for the cup-shaped housing with exact positional fixation; on the side of the bottom remote from the interior of the housing, two chambers are formed, through which the contact terminals are passed and which can be braced in the injection mold in an exactly predetermined way during the spray-coating process. Furthermore, between the bottom and the injection mold, a third chamber is also provided, inside which, through a delivery opening in the wall of the injection mold, the rodlike part for positioning the magnet coil can be introduced and passed through the third opening in the bottom of the housing. Inside these three chambers, the contact terminals are spray-coated, and the rodlike part is also initially spray-coated, all during the spray-coating process. At the end of the spray-coating process, after the retraction of the rodlike part, this third chamber is then fully filled.

Advantageously, the magnet coil is used in a distributor-type injection pump. In the case of the sealing between fuel-carrying parts of the fuel injection pump and fuel-free chambers that is required there, it must be noted that sealing the openings in the bottom of the cup-shaped housing by the plastic spray coating cannot be achieved 100%, since because of the different temperature of expansions of the insulating material and metal, an initially tight adhesion between the plastic and the metal housing does exist, but in operation it then undergoes separation. For this reason, it is necessary for the contact terminals that lead to the outside to be additionally sealed off from the component that otherwise closes off the fuel-carrying chambers of the distributor-type injection pump. This component, has a receptacle that entirely surrounds the insulating material closure part that protrudes to the outside from the third opening of the cup-shaped housing. As a result, at this location there is no communication between fuel-carrying parts and fuel-free parts of the distributor-type injection pump, so that a third sealing point is dispensed with here. If the rodlike part were still present here, then a third sealing point would have to be created, because a fuel-carrying gap might open up between the rodlike part and the plastic spray coating and threaten the tightness of the coil, or because on the other hand a flow through the component would also have to be furnished at this third point, which flow would then require extra sealing. Given the narrow construction of distributor-type injection pumps that furnish little installation space, it thus becomes possible to achieve a compact design without additional mounting space for seals.

BRIEF DESCRIPTION OF THE DRAWINGS

One exemplary embodiment of the invention is shown in the drawing and will be described in further detail in the ensuing description.

DESCRIPTION OF THE EXEMPLARY EMBODIMENT

Figure 1:
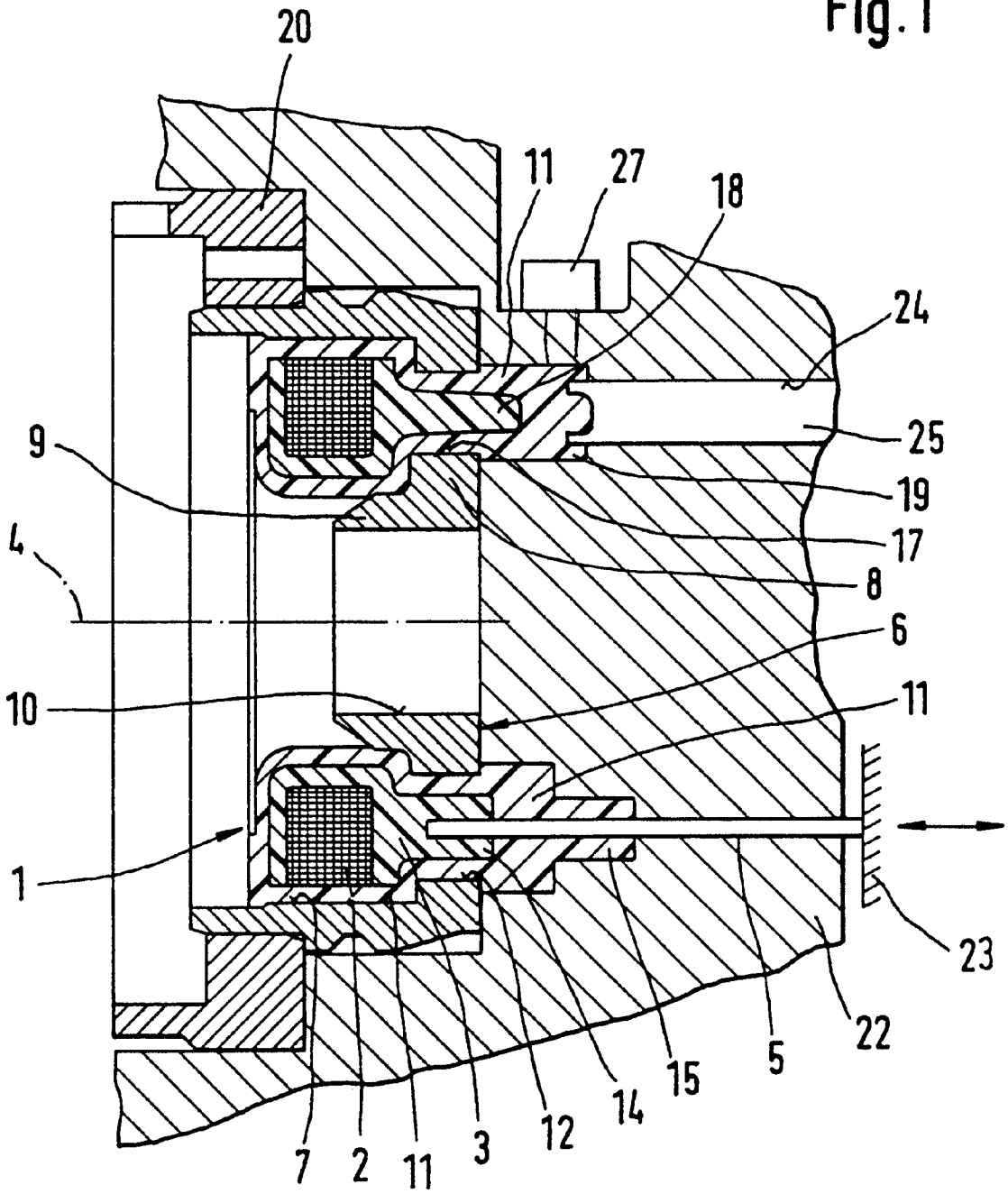
FIG. 1 shows the magnet coil of the invention in section, with a rodlike part that is to be retracted during the spray-coating process.

FIG. 1 shows a magnet coil 1 in section, which has a winding 2 placed in a winding carrier 3. The winding carrier takes the form of a ring of U-shaped cross section, such that an annular groove for receiving the coil 2 is formed, opening toward the outside, along the circumference. Two receptacles for contact terminals 5 of the winding 2 are provided on the winding carrier, axially parallel to its center axis 4; only one of these is shown here in section. This contact terminal is connected to the winding and serves the purpose of supplying and dissipating current.

The magnet coil 1 is disposed inside a cup-shaped housing 6, which has a circumferential wall 7, a bottom 8, and a stub 9 protruding from the bottom into the interior of the cup-shaped housing. The stub has a bore 10 located coaxially with the center axis, into which bore a magnet armature plunges and which serves to guide the magnetic flux from the magnet core to the armature. The magnet is thus embodied as a plunger armature magnet.

Between the stub 9 and the circumferential wall 7, a kind of annular chamber is formed, inside which the magnet coil is disposed. The coil body 3 is provided with a spray coating 11 of insulating material, such that the coil with its winding body 2 is completely surrounded by insulating material, and this insulating material contacts the circumferential wall 7, the internal bottom surface, and part of the stub.

For leading the contact terminals through the bottom 8 to the outside, two openings 12 are provided in the bottom 8, through which openings a stub 14 of the winding carrier that receives the respective contact terminal 5 protrudes to the outside, in each case surrounded by insulating material. Outside the bottom 8, the insulation spray coating 11 continues, forming a cylindrical insulation neck 15, which encloses part of the length of the respective contact terminal 5.

A third opening 17 is additionally provided in the bottom 8, and through it a similarly embodied stub 18 protrudes to the outside like the stub 14 of the winding carrier; this stub 18, in the fully produced state of the magnet coil, is likewise enclosed by insulating material 11. This insulating material is extended here as well toward the outside, forming an insulation stub 19. The two contact terminals mentioned and this insulation stub are disposed with approximately equal spacing from one another, in the manner of a three-point support. The housing 6, which is of metal, such as steel, is press-fitted into a steel ring 20, which serves as a further structural part for mounting the magnet coil for its later intended use. For the invention, this ring initially has no importance.

The magnet coil with its housing as in FIG. 1 is inserted into an injection mold 22, which is merely schematically suggested here. Corresponding recesses are present in this injection mold for receiving the cup-shaped housing and for forming the insulation stub 19 and the insulation neck 15 of the contact terminals. A pressure sensor 27, connected to a control unit not shown here, is disposed in the wall of the insulation stub. Arrangements 23 that serve to support the contact terminals 5 in an intended exact association with the location of the cup-shaped housing are also provided in the injection mold. These arrangements 23 may be embodied as blind bores, which at the same time form a depth stop, or they may be sealed passages through the wall of the injection mold, adjoining which there are stops for positionally fixing the contact terminals. The cross sections of the passages or blind bores are adapted to the cross section of the contact terminals, to form a tight closure. In addition, a further bore 24 is also provided in the injection mold 22; by way of this bore, a rodlike part 25 can be introduced, so that when the spray-coating with insulating material has not yet been done, it comes to contact the stub 18, or in other versions the winding carrier 3. With the aid of this rodlike part 25, the exact location of the winding 2 with the winding carrier 3 inside the cup-shaped housing is assured prior to the spray-coating.

An injection head not shown in further detail here is delivered for the spray-coating process from the opening side of the cup-shaped part and specifies the form of a spray coating 11, of the kind shown in the final state in FIG. 1. For the spray-coating process, insulating material is introduced in such a way that the insulating material flows around the magnet coil, secured against shifting, and after that emerges from the cup-shaped housing toward the openings 12 and 17 for further forming and filling up of the adjoining chambers between the cup-shaped housing 6 and the injection mold 22. Here the chamber forming the insulation neck and the chamber forming the insulation stub 19 are then filled up with plastic. Initially, the rodlike part is in its intended position, in which it fixes the magnet coil. If the plastic then escapes into the chamber forming the stub 19, then whenever the chamber is substantially filled with insulating material and accordingly the spray-coating of the magnet coil inside the housing is concluded the plastic trips a signal at the pressure sensor. This is the case for instance whenever the chamber forming the stub 19 is up to 90% filled with insulating material and in addition the openings 12 and 17 and the adjoining chambers inside the injection mold 22 are also filled up with insulating material. At that moment, via the control unit, when this pressure signal is output the rodlike part 25 is retracted, so that in the remainder of the spray-coating process, the chamber forming the insulation stub 19 is then filled completely and solely with insulating material.

In this way, the magnet coil that is spray-coated with insulating material in a completely fuel-tight way is obtained; the contact terminals are also surrounded with plastic in a region protruding from the bottom out of the cup-shaped housing. The rodlike part 25 serving the purpose of exact positional fixation is pulled out still during the spray-coating process, after which, following complete enclosure of the coil itself, the spray-coating process is virtually concluded. This is attained exactly by ascertaining the pressure in the chamber forming the stub 19; once again, a complete enclosure of the winding 2 with the winding carrier 3 takes place.

Figure 2:
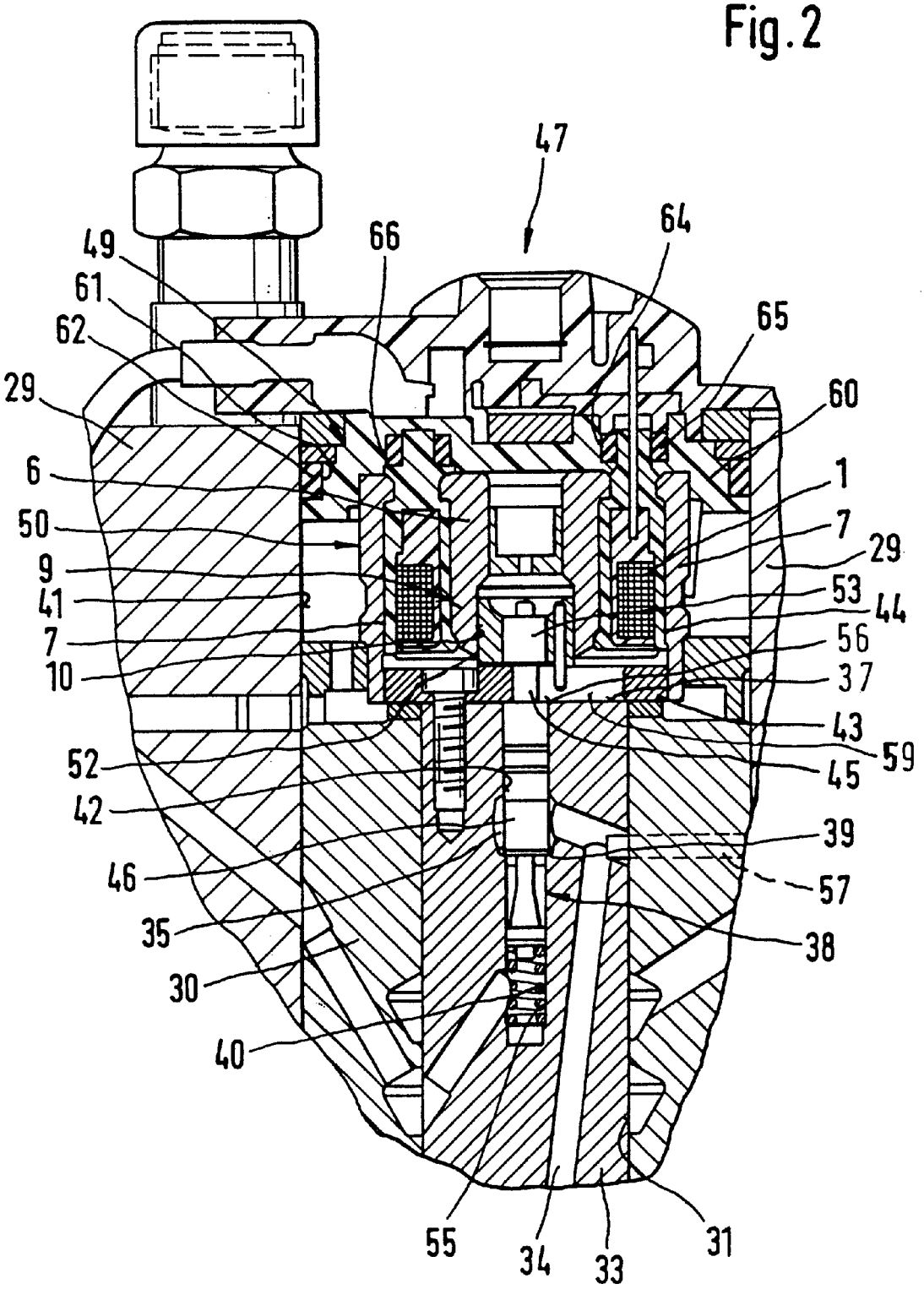
FIG. 2 shows the use of the magnet coil of FIG. 1 in a distributor fuel injection pump.

The magnet coil with the winding thus produced inside the cup-shaped housing is especially preferably used in a distributor-type injection pump, for instance of the kind shown in FIG. 2. Magnet coils that are produced in this way can be used in manifold other ways, as well, however. What is essential is that the winding of the magnet coil be spray-coated with plastic on all sides, except for the exit ends that are necessarily present of the contact terminals 5. Seals can be provided on these terminals in the region of the plastic enclosure of these contact terminals, with which seals a secure liquid-tight separation can be made between a region located toward the bottom of the cup-shaped housing and a region located toward the opening of the cup-shaped housing.

Especially advantageously, the magnet coil can be used in a distributor-type injection pump as in FIG. 2. This is shown in section in FIG. 2 in the portion that is essential here. A bushing 30 is inserted into a pump housing 29 of the fuel injection pump and in turn in its interior has a guide bore 31, in which a distributor 33 is guided. The distributor is driven for instance by the camshaft of an associated internal combustion engine. It is axially secured against displacement in the housing 29 and has a longitudinal conduit 34, which communicates on one side with a pump work chamber, not further shown here, and on the other discharges into a pressure chamber 35, which is part of a blind conduit 38 beginning at one face end 37 of the distributor and located coaxially with the axis of the distributor. The pressure chamber is defined on one side by a valve seat 39, which changes over into a partial bore 40 of the conduit 38 that leads onward toward the relief side. On the other side of the pressure chamber 35, a coaxial guide bore 42 adjoins it; it exits at the face end 37 of the distributor and receives a valve member 46 that cooperates with the valve seat 39. A magnet disk 43, which has a keyhole-like recess 44, is screwed onto the face end 37 of the distributor. A neck 45 of the valve member 46 of the magnet valve 47 protrudes through this recess into a narrow part that is coaxial with the axis of the distributor. The magnet valve is inserted with its magnet valve housing 49 into a recess 41 of the pump housing 29 of the fuel injection pump and fixed there in stationary fashion. The magnet valve housing 49 has an electromagnet 50 with the magnet coil 1, which is disposed inside a cup-shaped housing 6 that forms a magnet core which takes the form of an annular cup with a middle stub 9 as a tubular magnet core and with the circumferential wall 7 as an outer jacket of the magnet, between the latter and the stub, the magnet coil is supported with its winding 2. On the face end, toward the distributor, the magnet core is supplemented with the magnet disk 43, which is adapted in diameter to the inside diameter of the outer jacket of the magnet and forms only a narrow radial air gap with it. This makes it possible, with a stationary electromagnet 50, for the magnet disk 43, which is part of a magnet circuit, to rotate together with the rotating distributor 33.

A magnet armature in the form of a plunging armature 52 dips into the bore 10 of the stub 9. It is secured, adjoining a headlike end 53, on the neck 45 of the valve member 46 and, upon excitation of the magnet coil, actuates the valve member in the closing direction to assume its seat 39. Acting on the valve member in the opening direction is a compression spring 55, which is supported in the partial bore 40. The armature may also at the same time integrally form the headlike end 53 of the valve member 46.

The stroke of the valve member is defined by the contact of a shoulder 56 of the valve member with the magnet disk. The shoulder is formed by the transition from the part of the valve closing member 46 that slides in the guide bore 42 to the neck 45.

Via the guide bore 42, during operation of the injection pump, fuel can emerge into the chamber 59 adjoining the face end and thus come into contact with the magnet coil, and it could also escape from the distributor-type injection pump via the recess 41. The pump is therefore closed by a closure part 60, which at the same time serves to seal off the electromagnet 50 in the recess 41. To that end, the closure part has a circumferential groove 61, in which a seal 62 is placed that cooperates with the wall of the recess 41, and the closure part rests with its middle part on the cup-shaped housing 6, so that the latter part closes the bore 10. The closure part 60 has two through openings 64, through which the contact terminals 5 of the magnet coil are passed and then connected outside to the current source. Cooperating with the wall of these through openings 64 are sealing rings 65, which on the other side rest tightly against the insulation necks 15 of the contact terminals 5 and thus at this point as well prevent an escape of fuel to the outside. For receiving the insulation stub 19, the closure part 60 has a recess 66 closed toward the outside. Thus no seal is needed at this point, which becomes possible because of the special embodiment and production of the magnet coil 1 in its housing 6.

In this way, a version of a magnet valve that can be made easily and reliably while meeting all the required narrow tolerances and that is easy to mount is attained, with a magnet coil that is reliably protected against the penetration of liquid such as fuel to the winding, and which assures a tight closure of the magnet valve to prevent fuel from escaping to the outside in the case where it is used with a distributor-type injection pump, but also in other comparable applications as well.

The foregoing relates to a preferred exemplary embodiment of the invention, it being understood that other variants and embodiments thereof are possible within the spirit and scope of the invention, the latter being defined by the appended claims.

We claim:

1. A magnet coil (1), a housing, said magnet coil is disposed in an interior of said housing (6), said housing has a circumferential wall (7) and a bottom (8), and the coil (1) is electrically insulated from an outside of said housing by insulation material (11), the magnet coil has two contact terminals (5) leading to the outside from the housing, said two contact terminals are enclosed over a portion of their length by insulating material (11, 15), and which lead with their regions surrounded by insulating material through openings (12) in the bottom (8) of the housing (6) and have an electrical connection outside the housing, in which the insulation of the magnet coil (1) and of the contact terminals (5) with insulating material (11) is formed by spray-coating on all sides, which is simultaneously sprayed onto the inner walls of the housing and completely fills up the openings (12) in the bottom and closes them and positions the coil in a predetermined position inside the housing (6), the bottom (8) has a third opening (17), through which a rod-like part (25) can be introduced from the outside into the interior of the housing (6), in conjunction with the contact terminals (5) the part is supported on stops, the magnet coil (1) is kept stably spaced apart from the adjoining housing walls in an intended position inside the housing (6) during the spray-coating process and the part is removed again after the conclusion of the spray-coating process, and the third opening (17) is likewise filled and closed by insulating material (11), the openings (12, 17) receiving the contact terminals (5) and the rodlike part (25) are disposed such that the rodlike part and the contact terminals together produce a stable three-point support.

2. The magnet coil in accordance with claim 1, in which a stub (9) protrudes from the bottom (8) and projects centrally into the interior of the annularly embodied magnet coil (1), and the stub (9) serves to carry a magnetic flux to a magnet armature (52).

3. The magnet coil in accordance with claim 1, in which the third opening (17) is closed on the outside of the bottom (8) by an insulation stub (19) protruding from the bottom, at which stub a pressure measurement can be performed during the spray-coating process.

4. The magnet coil in accordance with claim 1, in which the third opening (17) is closed on the outside of the bottom (8) by an insulation stub (19) protruding from the bottom, at which stub a pressure measurement can be performed during the spray-coating process.

5. A magnet coil, a housing, said magnet coil is disposed in an interior of said housing (6), said housing has a circumferential wall (7) and a bottom (8), and the coil (1) is electrically insulated from an outside of said housing by insulation material (11), the magnet coil has two contact terminals (5) leading to the outside from the housing, said two contact terminals are enclosed over a portion of their length by insulating material (11, 15) and lead with their regions surrounded by insulating material through openings (12) in the bottom (8) of the housing (6) and having an electrical connection outside the housing, in which the insulation of the magnet coil (1) and of the contact terminals (5) with insulating material (11) is formed by spray-coating on all sides, which is simultaneously sprayed onto the inner walls of the housing and completely fills up the openings (12) in the bottom and closes them and positions the coil in a predetermined position inside the housing (6), the magnet coil (1) is used in a magnet valve (47) inserted into a distributor-type injection pump, the distribution-type injection pump has a rotationally driven distributor (33) that has a bore (42) on a face end, a valve member (46) is guided in said bore to control a fuel flow, said valve member is connected to an armature (52) of the magnet valve (47) that is guided in a stub (9) of the housing (6) of the magnet coil (1), and the magnet coil (1) is fastened in a recess (41) in the housing (20) of the distributor-type injection pump and is covered by a component (60) which is inserted tightly into the housing (29) of the distributor-type injection pump and there closes a fuel-carrying chamber (59) of the distributor-type injection pump adjoining the face end of the distributor (33), and the component (60) has two through openings (64), through which the region (15) of the contact terminals (5) surrounded by insulating material protrudes and there, with one seal (65) each between the component and the through opening (64), seals off the fuel-carrying chamber (59) from the outside.

6. The magnet coil in accordance with claim 5, in which the component (60) has a blind bore (66), which is used to receive an insulating material closure element (19) that protrudes from the bottom (8) of the housing (6) of the magnet coil (1) at a third opening (17) thereof.

7. The magnet coil in accordance with claim 5, in which a stub (9) that serves to carry a magnetic flux to a magnet armature (52) protrudes from the bottom and projects centrally into the interior of the annularly embodied magnet coil (1).

8. The magnet coil in accordance with claim 5, in which the bottom (8) has a third opening (17), through which a rod like part (25) can be introduced from the outside into the interior of the housing (6), by which part, in conjunction with the contact terminals (5) supported on stops, the magnet coil (1) is kept stably spaced apart from the adjoining housing walls in an intended position inside the housing (6) during the spray-coating process and which part is removed again after the conclusion of the spray-coating process, and the third opening (17) is likewise filled and closed by insulating material (11).

9. The magnet coil in accordance with claim 5, in which the openings (12, 17) receiving the contact terminals (5) and the rodlike part (25) are disposed such that the rodlike part and the contact terminals together produce a stable three-point support.

10. A method for producing a magnet coil (1), which is disposed in the interior of a housing (6), the housing has a circumferential wall (7) and a bottom (8), and a coil (1) is electrically insulated from an outside by insulation material (11) and has two contract terminals (5) leading to the outside from the housing, which are enclosed over a portion of their length by insulating material (11, 15), and which lead with their regions surrounded by insulating material through openings (12) in the bottom (8) of the housing (6) and have their electrical connection outside the housing, the method comprises fixing the housing (6) in an injection mold (22); introducing the rodlike part (25) through the wall of the injection mold (22) and through a third opening (17) in the bottom (8) of the housing (6) into the interior of the housing; arranging the magnet coil (1) into a proper position inside the housing (6) that is predetermined by the contact of the contact terminals (5) with stops and by the fixed rodlike part (25); closing a remaining opening of the cup-shaped housing (6) by an injection head surrounding the coil with clearance; injecting insulating material into said remaining opening removing the rodlike part (25) during the spray-coating process whenever the escape of insulating material at said opening (17) is indicated by a pressure signal of a pressure sensor tripped by the inflow of insulating material, closing said third opening in such a manner that the replenishing insulating material flowing in because the spray-coating process is not yet concluded closes the third opening (17) completely in the course of the removal of the rodlike part.

11. A method as set forth in claim 10, which comprises providing an injection mold (22) which has a receptacle for exact positional fixation of the cup-shaped housing (6), forming two chambers on a side of the bottom (8) of the housing (6) remote from the interior of the housing extending contact terminals through said two chambers, spray-coating said contact terminal with a partial spray coating (15), forming a third chamber via the injection mold and the bottom (8) with a delivery opening (24) in the wall of the injection mold (22), introducing the rodlike part (25) through the third opening for positioning the magnet coil (1) in the housing.

* * * * *